US009586782B2

(12) United States Patent
Chalifoux

(10) Patent No.: US 9,586,782 B2
(45) Date of Patent: Mar. 7, 2017

(54) MATERIAL DISPENSER

(71) Applicant: Paul B. Chalifoux, Cambria, CA (US)

(72) Inventor: Paul B. Chalifoux, Cambria, CA (US)

( * ) Notice: Subject to any disclaimer, the term of this patent is extended or adjusted under 35 U.S.C. 154(b) by 44 days.

(21) Appl. No.: 14/176,517

(22) Filed: Feb. 10, 2014

(65) Prior Publication Data

US 2014/0224920 A1 Aug. 14, 2014

Related U.S. Application Data

(60) Provisional application No. 61/850,259, filed on Feb. 11, 2013.

(51) Int. Cl.
*B65H 19/30* (2006.01)
*B65H 35/00* (2006.01)

(52) U.S. Cl.
CPC ..... *B65H 35/002* (2013.01); *B65H 2402/413* (2013.01); *Y10T 29/4984* (2015.01)

(58) Field of Classification Search
CPC ..... B65H 35/002; B65H 2402/413
USPC ..... 242/597.8, 400, 402, 405, 588.1, 588, 242/588.3
See application file for complete search history.

(56) References Cited

U.S. PATENT DOCUMENTS 1,554,082 A * 9/1925 Gerould ..... 242/129.6
2,581,190 A 1/1952 Hodges
2,978,155 A * 4/1961 Knutson ..... 225/25
3,125,264 A * 3/1964 English, Jr. ..... 225/78
3,176,892 A * 4/1965 Waltz ..... 225/66
3,217,955 A 11/1965 Tinkey
3,398,908 A * 8/1968 Thompson ..... 242/597.5
3,656,699 A * 4/1972 Schnyder et al. ..... 242/560
3,768,713 A * 10/1973 Lash ..... 225/34
4,088,276 A 5/1978 Littleton
4,606,485 A 8/1986 Rankin
4,735,342 A * 4/1988 Goldstein ..... 221/25
5,482,182 A * 1/1996 Thompson et al. ..... 221/73
5,641,109 A * 6/1997 Willoughby ..... 225/20
5,802,695 A 9/1998 Willoughby
7,077,184 B2 7/2006 Mertins, Jr. et al.
7,201,201 B2 4/2007 Grenier
2007/0158030 A1 7/2007 Kyriacou

* cited by examiner

*Primary Examiner* — William A Rivera

(74) *Attorney, Agent, or Firm* — Gardere Wynne Sewell LLP

(57) ABSTRACT

A material dispenser includes a support, an arm that extends from the support and a spool that is rotatably coupled to the arm. The spool is oriented such that an axis of rotation of the spool does not intersect with the support. The improved material dispenser may be worn on a forward-facing portion of a user's waist, a right-facing portion of a user's waist, a left-facing portion of a user's waist, or any other angular location on a user's waist. Material is dispensed by pulling the material away from the user's body in the corresponding direction (i.e., forward-facing, left-facing, right-facing, etc.).

19 Claims, 3 Drawing Sheets

MATERIAL DISPENSER

CROSS-REFERENCE TO RELATED APPLICATIONS

This application claims the benefit of U.S. Provisional Application No. 61/850,259 filed Feb. 11, 2013.

TECHNICAL FIELD

This disclosure relates in general to dispensers for tape and other materials, and, in particular, to a dispenser that can be worn on a forward-facing portion of a user's waist and can hold multiple rolls of material.

BACKGROUND OF THE DISCLOSURE

Dispensers are used to selectively distribute a desired amount of material, such as tape, from a storage unit. Unfortunately, dispensers for tape and other materials are often cumbersome to use, especially when a user has only one free hand to maneuver the dispenser. For example, material dispensers are often difficult to use while a user grasps a ladder with one hand and attempts to remove and cut the material with the other hand. In addition, many dispensers for materials such as, for example, tape, require a cutting edge that is awkwardly placed and can harm a user if it comes into contact with the user. Furthermore, these dispensers are also often configured for use in a single orientation, for example, on a right side of a user's waist, and must be reconfigured for use at a different location, such as a left side of a user's waist.

SUMMARY

In a first aspect, there is provided a material dispenser that includes a support, an arm that extends from the support and a spool that is rotatably coupled to the arm. The spool may include an axis of rotation that does not intersect with the support.

In certain embodiments, the arm extends at a right angle from the support.

In other embodiments, the axis of rotation of the spool is perpendicular to the arm.

In another embodiment, a cutter is coupled to a distal end of the arm.

In yet another embodiment, the cutter extends parallel to the axis of rotation of the spool. The cutter also extends from a first side of the arm and an opposite, second side of the arm.

In still another embodiment, the material dispenser includes a first spool and a second spool. The first spool may be coupled to a first side of the arm and the second spool may be coupled to a second side of the arm.

In some embodiments, the support is positionable on a forward-facing side of a user's waist and material is removed from the spool by pulling the material away from the user's waist.

In a second aspect, there is provided a tape dispenser that includes a support for contacting a user's body, a spool coupled to the support and a blade coupled to the support. The rotational axis of the spool does not intersect the user's body when the tape dispenser is in use.

In certain embodiments, the spool includes a first spool and a second spool and the blade is positioned adjacent to the first and second spools.

In other embodiments, the support includes an arm and the blade is coupled to an end of the arm so that the arm and the blade form a "T" shape.

In another embodiment, the spool includes a first spool and a second spool. The first spool may be located on a first side of the arm and the second spool may be located on a second, opposite side of the arm.

In yet another embodiment, a distance from a first end of the blade to a second, opposite end of the blade is greater than or equal to a distance from an outer edge of the first spool to an outer edge of the second spool.

In still another embodiment, the tape dispenser includes a bar to rotatably couple the spool to the arm.

In some embodiments, the spool is between about 1 and about 1.5 inches wide.

In a third aspect, there is provided a method of manufacturing a material dispenser. The method includes providing a base that includes a support and an arm extending from the support. The method also includes rotationally fixing a first spool to the arm so that an axis of rotation of the first spool does not intersect the support.

In certain embodiments, the method includes rotationally fixing a second spool to the arm so that an axis of rotation of the second spool does not intersect the support.

In other embodiments, the method includes fixing a cutter to an end of the arm so that a longitudinal axis of the cutter is parallel to the axis of rotation of the spool.

In another embodiment, fixing the cutter to the end of the arm includes positioning the cutter so that the cutter extends from a first side of the arm and a second, opposite side of the arm.

In another embodiment, the method includes coupling a securing mechanism to the base to allow the base to be secured to a user's belt.

In yet another embodiment, rotationally fixing the first spool to the arm includes fixing a bar to the arm and rotationally fixing the first spool to the bar.

In a fourth aspect, there is provided a material dispenser having a support and an arm extending from the support. The dispenser includes a roll support member configured to support a roll of material thereon, the roll support member extending from the arm and positioned such that a longitudinal axis of the roll support member does not intersect the support.

In certain embodiments, the roll support member is stationary.

In other certain embodiments, the roll support member is a spool

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
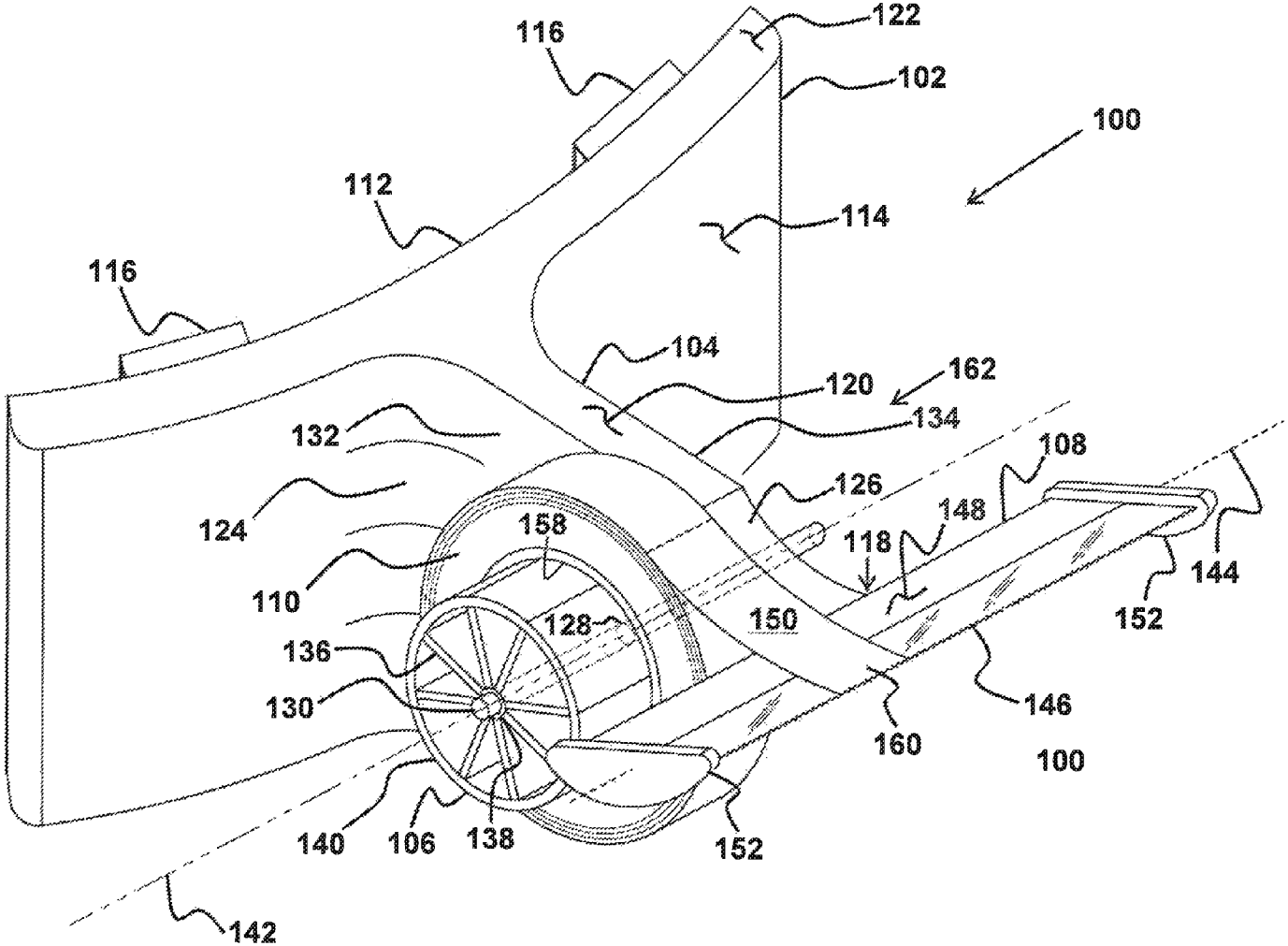
FIG. 1 is a perspective view of a material dispenser in accordance with this disclosure.

FIG. 1 is a perspective view of a material dispenser 100 that includes a support 102, an arm 104 that extends from the support 102, a roll support member in the form of a spool 106 rotatably coupled to the arm 104, and a cutter 108 coupled to a first end 118 of the arm 104. As will be described in more detail below, the material dispenser 100 may be worn on a forward-facing portion of a waist of a user or can be coupled at any other position on a user's waist (a right-facing portion, a left-facing portion, etc.). Thus, the material dispenser 100 can be oriented such that the cutter 108 is located away from a user's hands and arms. The material dispenser 100 can also be easily moved between the right-facing, forward-facing or left-facing positions without modifying the dispenser 100. In addition, in some embodiments the material dispenser 100 may hold several rolls 110 of material 150 at a time to allow a user to easily carry and use multiple types of materials 150. These and other embodiments of the material dispenser 100 are described in more detail below.

The support 102 of the dispenser 100 includes a rear surface 112 that is configured to contact a belt or other garment of a user (not shown), and a front surface 114 to which the arm 104 is coupled. As shown in FIG. 1, the support 102 may be curved to conform to the average shape of a user's waist. The support 102 may be made of a rigid material or, in some embodiments, may be made of a flexible material that conforms to the shape of the user's waist. While the support 102 is rectangular in the embodiment shown in FIG. 1, the support 102 may be any other suitable shape, such as a round shape or a triangular shape.

The support 102 may include one or more attachment mechanisms 116, such as clips, on the rear surface 112 to removably secure the support 102 to a user's garment, such as a belt. As such, the material dispenser 100 may be secured to a user's garment so that the user does not need to hold the material dispenser 100 in the user's hands while working. In some embodiments, the support 102 is integrally formed with a belt (not shown) so that the user can secure the support 102 to the user by securing the belt to the user. As will be described in more detail below, the material 150 may be removed from the material dispenser 100 by a user with one hand when the dispenser 100 is worn on a user's waist.

The dispenser 100 also includes an arm 104 that extends from the front surface 114 of the support 102. The arm 104 may be located at any suitable position on the front surface 114 of the support 102 and may extend at any suitable angle from the front surface 114. In the embodiment shown in FIG. 1, for example, the arm 104 is centrally located on the front surface 114 of the support 102 and extends at a right angle to the front surface 114. A top surface 120 of the arm 104 may be coplanar with a top surface 122 of the support 102 and the arm 104 may have a height that corresponds to the height of the support 102. The intersection between the arm 104 and the support 102 may include a fillet 124 to provide additional structural strength to the arm 104. The arm 104 and the support 102 may be separate pieces that are secured together or the arm 104 and the support 102 may be one integral piece. As shown in FIG. 1, the arm 104 may also include a cutout portion 126 to allow for easy grasping of material 150 from the material roll 110.

In the embodiment illustrated in FIG. 1, the arm 104 includes an opening 128 that receives a rod 130 to rotatably hold the spool 106 on the arm 104. The rod 130 extends from a first side 132 of the arm 104 and may also extend from an opposite, second side 134 of the arm 104. In FIG. 1, for example, the rod 130 extends from the first side 132 of the arm 104 and from the second side 134 of the arm 104 so that one or more spools 106 may be coupled to the rod 130 on the first side 132 of the arm 104 and one or more spools 106 may be coupled to the rod 130 on the second side 134 of the arm 104. In some embodiments, the rod 130 extends from the first side 132 of the arm 104 and a second rod (not shown) extends from the second side 134 of the arm 104. It should also be understood that the rod 130 may be formed integral with the arm 104.

According to embodiments disclosed herein, the spool 106 is cylindrical in shape and includes a plurality of spokes 136 extending from a central cylinder 138 to an outer cylinder 140. In other embodiments, the spool 106 may have any suitable shape or configuration that provides for a rotatable connection between the material roll 110 and the arm 104. For example, in lieu of the spokes 136, the spool may include a sold central portion. The spool 106 may also have any suitable radius. For example, in some embodiments, the spool 106 has a radius that is slightly smaller than an inner radius of a typical material roll 110. The spool 106 may also have any suitable width. For example, the spool 106 may be wide enough to hold multiple material rolls 110 or may have a width that corresponds to the width of a single material roll 110. For example, in some embodiments, the spool 106 is sufficiently wide to hold three tape rolls that are each one inch wide. In other embodiments, the spool 106 is approximately one inch wide to correspond to a one inch width tape roll. In other embodiments, the spool 106 is approximately 1.5 inches wide to correspond to a 1.5 inch wide tape roll. In other embodiments, the spool 106 is between about 1 inch wide and about 1.5 inches wide. The spool 106, which is rotatably coupled to the first side 132 of the arm 104, may be oriented such that the axis of rotation 142 of the spool 106 does not intersect the support 102. In the embodiment illustrated in FIG. 1, for example, the axis of rotation 142 of the spool 106 is perpendicular to the arm 104 and the arm 104 is perpendicularly oriented to the support 102. However, other angular configurations of the axis of rotation 142 may be used.

The dispenser 100 also includes a cutter 108 that is secured to the first end 118 of the arm 104. A central portion of the cutter 108 is secured to the arm 104 so that the cutter 108 and the arm 104 form a "T" shape when viewed from above. In other embodiments, the cutter 108 may not be centered on the arm 104 so that the cutter 108 extends further from one side of the arm 104 than the opposite side of the arm 104. A longitudinal axis 144 of the cutter 108 is parallel to the axis of rotation 142 of the spool 106 and a predetermined distance is maintained between the longitudinal axis 144 of the cutter 108 and the axis of rotation 142 of the spool 106. In some embodiments, the distance between the cutter 108 and the axis of rotation 142 of the spool is slightly larger than the thickness of a typical material roll 110 so that a typical material roll 110 that is secured to the spool 106 can rotate without contacting the cutter 108.

The cutter 108 includes a blade 146 with a cutting edge for cutting the material 150 from the material roll 110. The blade 146 may be integrally formed with the cutter 108, the arm 104 and the support 102, or may be a separate part that is coupled to the cutter 108. In some embodiments, for example, the blade 146 is made of a metal material and is coupled to a plastic cutter 108, arm 104 and support 102. In some embodiments, a top surface 148 of the cutter 108 is configured to allow the material 150, such as, for example, tape, from the material roll 110 to stick to the top surface 148 between each use of the material 150. The cutter 108 may include buffers 152 on the ends of the cutter 108 to protect the ends of the cutter 108 from accidentally contacting a user's hands or garments.

Figure 2:
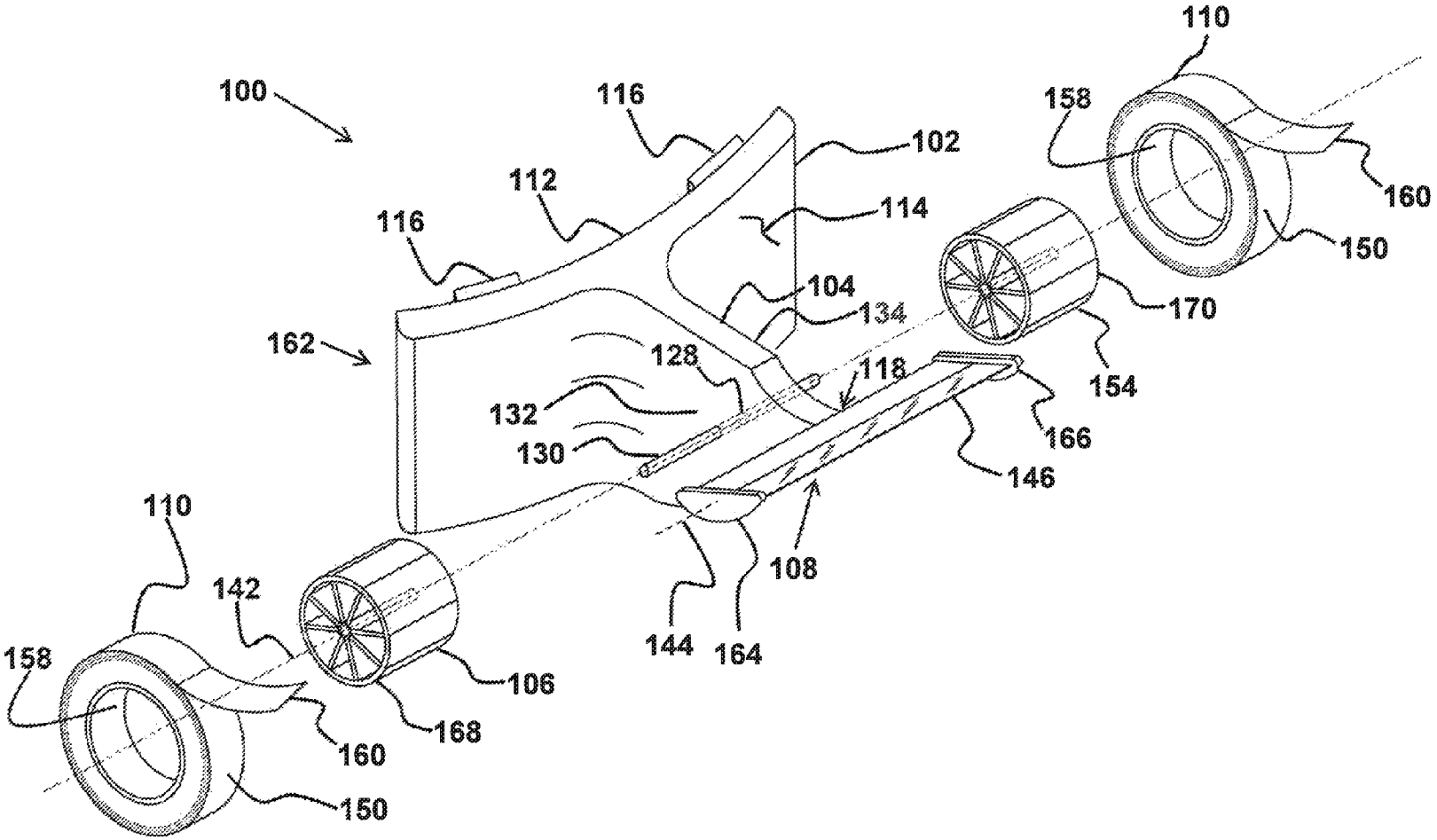
FIG. 2 is an exploded perspective view of a material dispenser that includes two spools in accordance with this disclosure.

FIG. 2 is an exploded perspective view of a material dispenser 100 that includes two spools: a first spool 106 located adjacent to the first side 132 of the arm 104 and a second spool 154 located adjacent to the second side 134 of the arm 104. The first spool 106 is rotatably coupled to the arm 104 by the rod 130 and the second spool 154 is also rotatably coupled to the arm 104 by an opposite end of the rod 130. In some embodiments, the first spool 106 may be coupled to the arm 104 by a first rod 130 while the second spool 154 is coupled to the arm 104 by a second rod (not shown). Each spool 106 and 154 may include one or more material rolls 110 so that a user may have several options of materials 150 to choose from when using the dispenser 100. The cutter 108 may be configured such that a distance from a first end 164 of the cutter 108 to an opposite, second end 166 of the cutter 108 is greater than or equal to a distance from an outer edge 168 of the first spool 106 to an outer edge 170 of the second spool 154 when the dispenser 100 is fully assembled. As such, material 150 from multiple rolls 110 placed on the first and second spools 106 and 154 may be cut by the cutter 108 even if the roll 110 of material 150 is located near the outer ends 168 or 170 of the spools 106 or 154.

In some embodiments, more than two spools 106 or 154 may be included on first side 132 of the arm 104 or on the second side 134 of the arm 104. For example, in some embodiments an additional spool (not shown) may be rotatably coupled to the rod 130 so that the additional spool is adjacent to the first spool 106 on the first side 132 of the arm 104. The first spool 106 and the additional spool may rotate independently of each other on the rod 130. Thus, material 150 may be dispensed from a material roll 110 on the first spool 106 while the additional spool remains stationary on the rod 130. Alternatively, material 150 may be dispensed from a material roll 110 on the additional spool while the first spool 106 remains stationary on the rod 130. One or more additional spools (not shown) may also be positioned adjacent to the second spool 154 on the second side 134 of the arm 104. The additional spools may be the same wide, shape and size as the first spool 106 or the second spool 154 or may be a different width, shape and size than the first and second spools 106 and 154.

The first and second spools 106 and 154 and any additional spools may rotate independently of each other or may be linked to rotate with one or more other spools. Spacers (not shown) may be placed between adjacent spools 106 or 154 and additional spools to allow for unimpeded independent rotation. Alternatively, in some embodiments, no spacers are included between adjacent spools 106 or 154 and additional spools.

Figure 3:
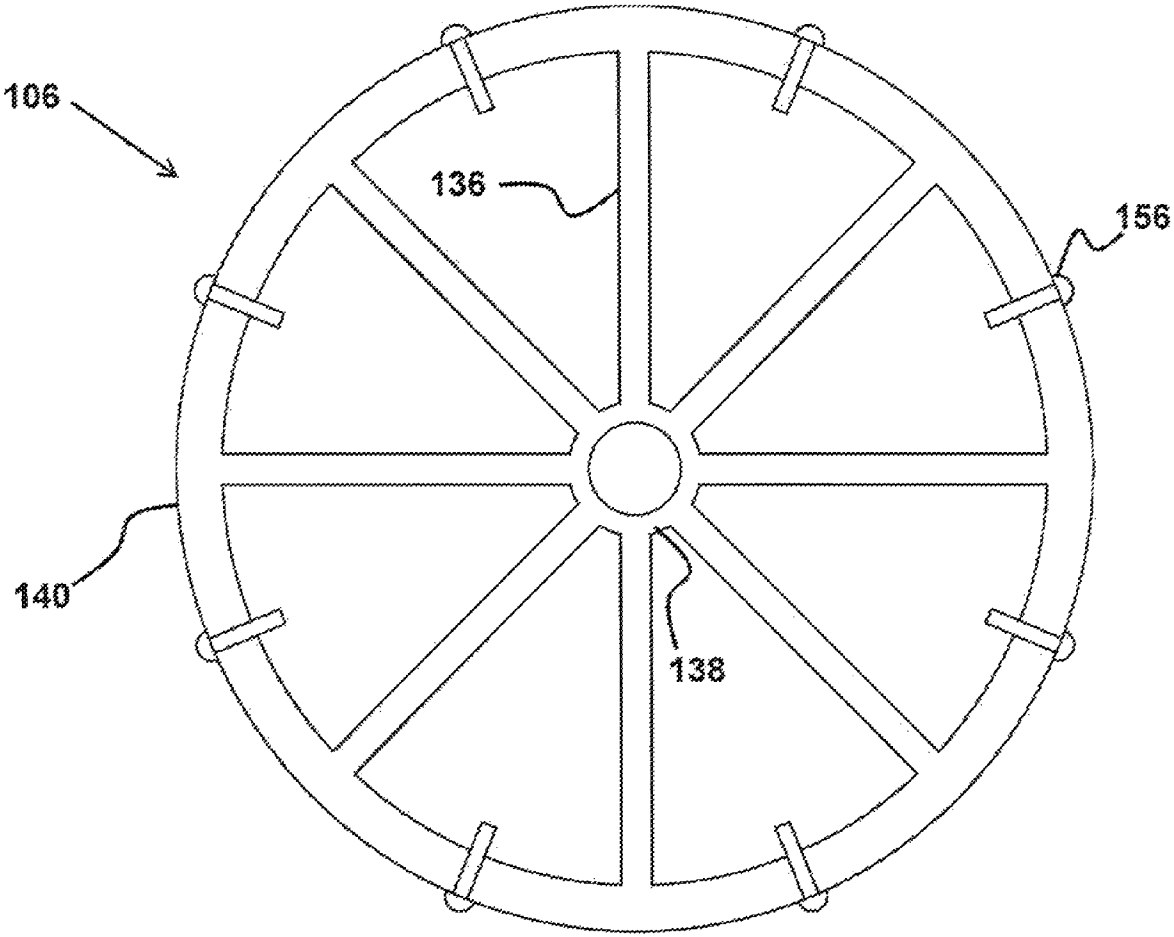
FIG. 3 is a front view of a spool in accordance with this disclosure.

FIG. 3 is a front view of a spool 106 that includes an inner cylinder 138, a plurality of spokes 136, an outer cylinder 140 and a plurality of gripping members 156. The gripping members 156 may be positioned on the outer cylinder 140 to provide a surface to which rolls 110 of material 150 may be coupled. In some embodiments, the gripping members 156 are separate pieces that are coupled to the outer cylinder 140. In other embodiments, the gripping members 156 are formed integrally with the outer cylinder 140. In some embodiments, the gripping members 156 are raised ridges on an outer surface of the outer cylinder 104 that extend to a distance from a center of the inner cylinder 138 that is slightly larger than the inner radius of a typical tape roll (not shown). As such, when a typical tape roll is placed on the outer cylinder 104, the material of the tape roll deforms slightly and frictionally engages the gripping members 156 to hold the tape roll to the spool 106. In other embodiments, the gripping members 156 are made of a soft siliconized rubber or other deformable material that is coupled to the outer cylinder 140. In some embodiments, the outer cylinder 140 may include troughs (not shown) into which the gripping members 156 are situated. The gripping members 156 may be secured to the outer cylinder 140 in any other suitable manner. In some embodiments, the spool 106 is expandable to provide additional securing forces to secure the rolls 110 of material 150 to the spool 106.

In use, one or more rolls 110 of material 150, such as tape rolls, are secured to the spools 106 and 154 by placing the spools 106 and 154 through an interior opening 158 of the rolls 110 of material 150, as shown in FIGS. 1 and 2. Referring to FIG. 3, the gripping members 156 may hold the rolls 110 of material 150 to the spool 106.

Referring again to FIGS. 1 and 2, once the desired number of rolls 110 are coupled to the spools 106 and 154, the support 102 is secured to a user's belt or other garment using one or more attachment mechanisms 116. The dispenser 100 is thus suspended from the user's waist without the need for the user to hold the dispenser 100 with the user's hands.

In use, the material 150 is dispensed from the dispenser 100 by grasping a free end 160 of the material 150 and pulling the material 150 away from the user. For example, when the dispenser 100 is worn in a forward-facing position on the user's waist, the user pulls the material 150 away from the user's body in a forward direction. Similarly, when the dispenser 100 is positioned on a user's right side, the user pulls the material 150 away from the user's body in a right-facing direction. Likewise, when the dispenser 100 is positioned on a user's left side, the user pulls the material 150 away from the user's body in a left-facing direction.

When the desired amount of material 150 has been removed, the user moves the material 150 downward onto the blade 146 of the cutter 108 to sever the material 150. If the material 150 includes an adhesive, such as a tape material, a free end 160 of the material 150 may adhere to the cutter 108 to allow for easy grasping of the material 150 for the next use. The user may disperse the same material 150 in subsequent disbursements, or may disperse different materials 150, for example, materials 150 from the rolls 110 on the second spool 154, in subsequent disbursements.

As discussed above, the support 102 can be conveniently coupled to any suitable position on the user and can be moved from one position on the user to another position on the user without reconfiguring the dispenser 100. In one embodiment, for example, the support 102 is first coupled to a forward-facing portion of a user's waist. As such, the cutter 108 is positioned away from the area in which a user's hands and arms 104 hang at a resting position. In addition, locating the support 102 at a forward-facing portion of the user's waist allows a user to conveniently remove material 150 by grasping the material with one hand and moving the material 150 away from the user in a forward direction against the cutter 108. The support 102 can then be moved to a right or left side of a user's waist, or any other angular location on a user's waist, by simply rotating the dispenser 100 while it is attached to the user's waist. The angular position of the support 102 can be changed without reconfiguring the dispenser 100 before it is used again. For example, a user may locate the support 102 on the user's left side while working on the user's left side. The user may then need to work on the user's right side. The user may simply rotate the dispenser 100 to the right side of the user's waist and then continue to use the dispenser 100 without reconfiguring the cutter 108, spools 106 and 154 or other features of the dispenser 100. In all positions (i.e., on the user's right side, on the user's left side, centrally located, etc.), the material 150 can be dispensed from the dispenser 100 by pulling the material 150 away from the user and cutting the material 150 on the cutter 108 due to the location of the axis of rotation 142 of the spools 106, 154 does not interest the support 102.

There is also described herein a method of manufacturing a material dispenser 100. A base 162 is provided that includes a support 102 and an arm 104 extending from the support 102. The support 102 and the arm 104 may be manufactured as a unitary piece or may be manufactured as separate pieces that are subsequently coupled together. A first spool 106 is rotationally fixed to the arm 104 so that the axis of rotation 142 of the spool 106 does not intersect the support 102. A second spool 154 may also be rotationally fixed to an opposite side of the arm 104 from the first spool 106 so that the axis of rotation 142 of the second spool 154 does not intersect the support. A cutter 108 may then be attached to the first end 118 of the arm 104. The cutter 108 is aligned so that a longitudinal axis 144 of the cutter 108 is parallel to the axis of rotation 142 of the first and second spools 106 and 154. The cutter 108 may extend from a first side 132 of the arm 104 and a second side 134 of the arm 104 so that rolls 110 of material 150 placed on any portion of the spools 106 and 154 can be cut by the cutter 108. One or more securing mechanisms 116 coupled to the support 102 allow the material dispenser 100 to be secured to a user's garment, such as a belt.

In alternate embodiments, the roll support member or spool 106 may be a non-rotatable stationary support member (not illustrated) that extends from one or both sides of the arm 104. For example, in one alternate embodiment, the roll support member may be a stationary cylindrical member cantilevering from one or both sides of the arm 104 and having a diameter slightly smaller than the interior opening 158 of the roll 110 such that the roll 110 may rotate/turn with respect on the stationary support member on a rotational axis 142. Similar to the axis of rotation 142 of the spools 106, 154 in FIGS. 1 and 2, for example, the longitudinal axis of such stationary support member is positioned such that the axis will not intersect the support 102 resulting in a configuration such that when the material 110 is pulled or otherwise dispensed, it is pulled away from the user's body in order gain the benefits described above. Accordingly, in alternate embodiments, a rotatable spool 106, 154 may be omitted and replaced with a stationary support member of any size or cross sectional shape for rotationally supporting rolls 110 thereon along an axis of rotation 142.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A wearable material dispenser for dispensing material away from a user's body, comprising:

a support comprising a first side and a second side opposite from the first side, wherein at least a portion of the second side is formed having a concave curved rear surface and a slot to receive a garment to support the wearable material dispenser against a user's waist;

an arm comprising a first end coupled to the first side of the support and a second end extending away from the first side of the support, a top wall, a bottom wall and a pair of sidewalls extending between the first and second ends;

a pair of spools rotatably coupled to respective sidewalls of the arm, wherein the pair of spools include an axis of rotation that do not intersect the support;

a cutter disposed on the second end of the arm wherein the pair of spools are positioned at least partially between the cutter and the support, the cutter including a top surface to receive and support at least a portion of the material thereon and a blade for severing the material; and wherein the top wall of the arm further includes a cutout portion disposed at least partially between the pair of spools and the cutter to provide a recessed area to allow for grasping of the material.

2. The wearable material dispenser according to claim 1, wherein the arm extends at a right angle from the support.

3. The wearable material dispenser according to claim 1, wherein the axis of rotation of the pair of spools are perpendicular to the arm.

4. The wearable material dispenser according to claim 1, wherein a longitudinal axis of the blade does not intersect the support.

5. The wearable material dispenser according to claim 4, wherein the blade extends parallel to the axis of rotation of the pair of spools and wherein the cutter extends from a first side of the arm and from an opposite, second side of the arm.

6. The wearable material dispenser of claim 1, wherein the cutter further includes buffers on each end of the cutter, the buffers including a wall covering exposed ends of the blade.

7. The wearable material dispenser according to claim 1, wherein the pair of spools are rotatable such that material is removed from the spool by pulling the material away from the first side of the support.

8. A wearable tape dispenser, comprising:

a support comprising a first side and a second side opposite the first side, wherein at least a portion of the second side is non-planar;

a slot on the second side of the support, the slot sized to receive a portion of a garment to support the wearable tape dispenser on a user's body;

an arm having a first end coupled to the first side of the support, a second end extending away from the first side of the support, a top wall, a bottom wall, and a pair of sidewalls;

a spool rotatably coupled to one of the sidewalls of the arm, the spool rotatable about a rotational axis, wherein the rotational axis of the spool does not intersect the support when the tape dispenser is in use;

a blade coupled to the support, wherein the blade comprises a cutting edge having a longitudinal axis that does not intersect the support when the tape dispenser is in use;

wherein at least a portion of the spool is positioned between the first side of the support and the blade; and wherein the top wall of the arm further includes a cutout portion disposed at least partially between the spool and the blade providing a recessed passage to allow for grasping of the tape.

9. The wearable tape dispenser according to claim 8, wherein the spool comprises a first spool and a second spool and the blade is positioned adjacent to the first and second spools.

10. The wearable tape dispenser according to claim 8, wherein the support comprises an arm and the blade is coupled to an end of the arm so that the arm and the blade form a "T" shape.

11. The wearable tape dispenser according to claim 10, wherein the spool comprises a first spool and a second spool, wherein the first spool is located on a first side of the arm and the second spool is located on a second, opposite side of the arm.

12. The wearable tape dispenser according to claim 11, wherein a distance from a first end of the blade to a second, opposite end of the blade is greater than or equal to a distance from an outer edge of the first spool to an outer edge of the second spool.

13. The wearable tape dispenser according to claim 10, further comprising a bar to rotatably couple the spool to the arm.

14. The wearable tape dispenser according to claim 8, wherein the spool is between about 1 and about 1.5 inches wide.

15. A method of manufacturing a wearable material dispenser, comprising:

providing a base comprising a support and an arm, wherein the support comprises a first side and a second side opposite from the first side, wherein at least a portion of the second side comprises a curved rear surface to contact a user, wherein the arm extends from the first side of the support;

providing a slot on the second side of the support to receive a garment of a user to support the material dispenser on the user;

rotationally fixing a first spool to the arm so that an axis of rotation of the first spool does not intersect the support;

fixing a cutter to the arm, wherein fixing the cutter comprises providing a cutting edge having a longitudinal axis that does not intersect the support when the material dispenser is in use, and positioning the cutter to the arm such that at least a portion of the first spool is located between the first side of the support and the cutter;

forming a cutout on at least a portion of the arm between the cutter and the first spool, the cutout providing a space for grasping of the material when supported on the first spool; and forming buffers on each end of the cutter, the buffers including a wall to cover exposed ends of the cutter.

16. The method according to claim 15, further comprising rotationally fixing a second spool to the arm so that an axis of rotation of the second spool does not intersect the support.

17. The method according to claim 15, wherein fixing the cutter to the arm further comprises positioning the cutter so that a longitudinal axis of the cutter is parallel to the axis of rotation of the spool.

18. The method according to claim 17, wherein fixing the cutter to the arm further comprises positioning the cutter so that the cutter extends from a first side of the arm and a second, opposite side of the arm.

19. The method according to claim 15, wherein rotationally fixing the first spool to the arm comprises fixing a bar to the arm and rotationally fixing the first spool to the bar.

* * * * *